US011248878B2

(12) United States Patent
Klein

(10) Patent No.: US 11,248,878 B2
(45) Date of Patent: Feb. 15, 2022

(54) BED HOOD

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 368 days.

(21) Appl. No.: 16/329,006

(22) PCT Filed: Aug. 31, 2017

(86) PCT No.: PCT/IL2017/050974
§ 371 (c)(1),
(2) Date: Feb. 27, 2019

(87) PCT Pub. No.: WO2018/042436
PCT Pub. Date: Mar. 8, 2018

(65) Prior Publication Data

US 2019/0204048 A1 Jul. 4, 2019

Related U.S. Application Data

(60) Provisional application No. 62/381,585, filed on Aug. 31, 2016.

(51) Int. Cl.

| | |
|---|---|
| ***F41H 5/24*** | (2006.01) |
| ***A47C 31/00*** | (2006.01) |
| ***A47C 21/00*** | (2006.01) |
| ***E05G 1/024*** | (2006.01) |

(52) U.S. Cl.
CPC ..... *F41H 5/24* (2013.01); *A47C 21/00* (2013.01); *A47C 31/00* (2013.01); *E05G 1/024* (2013.01); *A47C 21/003* (2013.01); *A47C 31/002* (2013.01)

(58) Field of Classification Search
None
See application file for complete search history.

(56) References Cited

U.S. PATENT DOCUMENTS

| | | | | |
|---|---|---|---|---|
| 2004/0158920 | A1* | 8/2004 | Walling | A47C 31/002 5/2.1 |
| 2006/0248827 | A1* | 11/2006 | Meeker | E04H 9/10 52/309.15 |
| 2007/0192955 | A1 | 8/2007 | Matoba | |
| 2013/0000225 | A1 | 1/2013 | D'Ancona | |
| 2017/0314255 | A1* | 11/2017 | Klein | E04H 9/10 |

FOREIGN PATENT DOCUMENTS

| | | | | |
|---|---|---|---|---|
| CN | 202151236 U | * | 2/2012 | A47C 31/002 |
| CN | 202151236 U | | 2/2012 | |
| CN | 105442898 A | * | 3/2016 | |

* cited by examiner

*Primary Examiner* — David R Hare
*Assistant Examiner* — Adam C Ortiz
(74) *Attorney, Agent, or Firm* — William H. Dippert; Laurence A. Greenberg; Werner H. Stemer

(57) ABSTRACT

A protective hood for individuals positioned in hazard areas is provided that comprises a constant hood structure having an opening, wherein the hood structure is configured to accommodate a portion of a bed that partially protrudes through the opening; a closing board outwardly connected to the hood structure and positioned opposite the opening; and a movable portion sleeved juxtaposed to the constant structure, wherein the movable portion is configured to move relative to the constant structure so as to elongate the constant structure from a first position in which the movable portion is fully adjacent to the constant structure and a second position in which the movable portion is extended outwardly beyond the opening so as to cling to the closing board and form a protected and secure inner space.

16 Claims, 5 Drawing Sheets

BED HOOD

CROSS-REFERENCE TO RELATED APPLICATIONS

The present application is a National Phase filing under 35 U.S.C. § 371 of International Patent Application No. PCT/IL2017/050974, filed Aug. 31, 2017, which is based upon and claims the benefit of the priority date of U.S. Provisional Patent Application Ser. No. 62/381,585, filed Aug. 31, 2016, each of which is expressly incorporated herein by reference in its entirety.

TECHNICAL FIELD

The present disclosed subject matter relates to personal protection. More particularly, the present disclosed subject matter relates to bed hoods for ballistic protection.

BACKGROUND

Personal ballistic protection in war, conflict, or hazard zones as well as zones that are susceptible to disasters such as earthquakes is crucial especially for soldiers and health-care personnel that are positioned in those zones and need constant protection. The problem is intensified at night or between shifts, when those people need their personal space for rest. Therefore, it is required to provide personal ballistic protection.

Unless otherwise defined, all technical and scientific terms used herein have the same meaning as commonly understood by one of ordinary skill in the art to which this disclosed subject matter belongs. Although methods and materials similar or equivalent to those described herein can be used in the practice or testing of the present disclosed subject matter, suitable methods and materials are described below. In case of conflict, the specification, including definitions, will control. In addition, the materials, methods, and examples are illustrative only and not intended to be limiting.

SUMMARY

It is an object of this disclosure to provide a bed hood for ballistic protection that provides a personal space for an individual or a small group of people to rest or sleep with no concerns.

It is another object to provide a personal space with ballistic and other protection for resting, the space is provided with multimedia and communication capabilities.

It is therefore provided a protective hood for a bed comprising:

- a constant hood structure having an opening, wherein the hood structure is configured to accommodate a portion of the bed that partially protrudes through the opening;
- a closing board outwardly connected to the hood structure and positioned opposite the opening;
- a movable portion sleeved juxtaposed to the constant structure, wherein the movable portion is configured to move relative to the constant structure so as to elongate the constant structure from a first position in which the movable portion is fully adjacent to the constant structure and a second position in which the movable portion is extended outwardly beyond the opening so as to cling to the closing board and form a protected and secure inner space.

In accordance with another embodiment, the closing board is connected to an end of the bed that protrudes the opening.

In accordance with another embodiment, the hood is further provided with a sliding mechanism configured to allow the movable portion to slide between the first position and the second position.

In accordance with another embodiment, the sliding mechanism is connected between the hood structure and the moving portion and comprises a rail and corresponding wheels that slide along each other.

In accordance with another embodiment, the hood structure is an open box.

In accordance with another embodiment, the movable portion is in a shape of an open tunnel.

In accordance with another embodiment, isolating material is provided between the hood structure and the movable portion.

In accordance with another embodiment, the isolating material can be sponge or foamed polymers made of material selected from a group comprising polystyrene or polyurethane, or a combination thereof.

In accordance with another embodiment, the hood structure, the movable portion, and the closing board are covered with ballistic protecting boards connected to a corresponding to framework.

In accordance with another embodiment, the framework is configured to receive a plurality of adjacent ballistic protecting boards that form a multilayer protection.

In accordance with another embodiment, the ballistic protecting boards are made of materials selected from a group of materials comprising hard metals such as steel, fiberglass, materials such as polymers as polyethylene or Kevlar as well as composite materials and combination thereof.

In accordance with another embodiment, the protective hood further provided with ventilation holes.

In accordance with another embodiment, the ventilation holes enables air conditioning.

In accordance with another embodiment, the ventilation holes further provided with blast valves.

In accordance with another embodiment, the protective hood further provided with at least one side window made of a resistant and transparent material.

In accordance with another embodiment, the protective hood further provided with multimedia system.

In accordance with another embodiment, said constant hood structure is provided with legs to support the protective hood.

In accordance with another embodiment, a lower part of the closing board is at a same lower level as the legs or provided with additional legs that are at a same lower level as the legs.

In accordance with yet another embodiment, it is provided a ballistically protecting hood comprising:

- a constant hood structure having an opening;
- a bed partially accommodated within the hood structure and partially protrudes through the opening;
- a closing board outwardly coupled to the hood structure and positioned opposite the opening beyond the bed;
- a movable portion sleeved juxtaposed to the constant hood structure, wherein the movable portion is configured to move relative to the constant structure so as to elongate the constant structure from a first position in which the movable portion is fully adjacent to the constant structure exposing a portion of the bed and a second position in which the movable portion is extended outwardly beyond the opening so as to cling to the closing board and form a protected and secure inner space;

wherein ballistic boards cover the protecting hood from all exposed sides.

BRIEF DESCRIPTION OF THE DRAWINGS

Some embodiments of the disclosed subject matter described, by way of example only, with reference to the accompanying drawings. With specific reference now to the drawings in detail, it is stressed that the particulars shown are by way of example and for purposes of illustrative discussion of the preferred embodiments of the present disclosed subject matter only, and are presented in the cause of providing what is believed to be the most useful and readily understood description of the principles and conceptual aspects of the disclosed subject matter. In this regard, no attempt is made to show structural details of the disclosed subject matter in more detail than is necessary for a fundamental understanding of the disclosed subject matter, the description taken with the drawings making apparent to those skilled in the art how the several forms of the disclosed subject matter may be embodied in practice.

DETAILED DESCRIPTION

Figure 1:
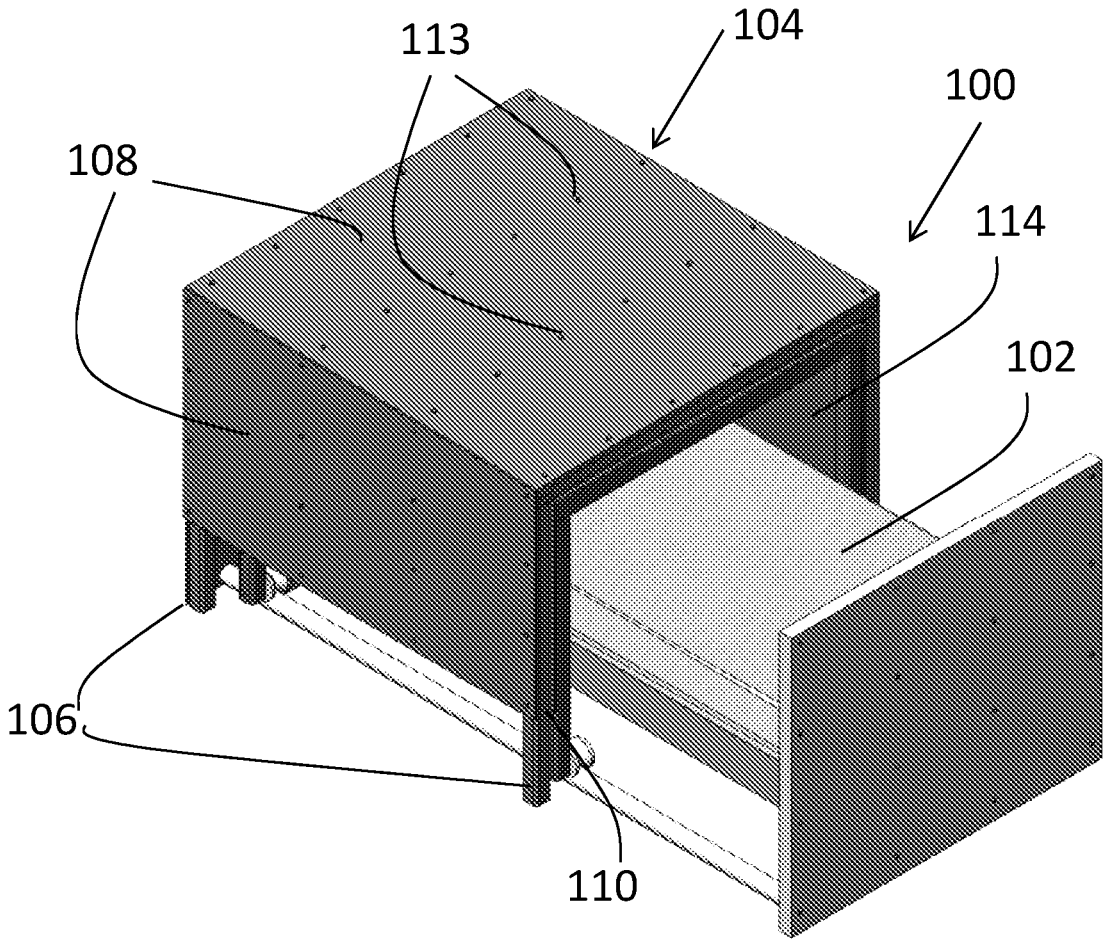
FIG. 1 illustrates a ballistic hood, in accordance with some exemplary embodiments of the disclosed subject matter in an open state.

Before explaining at least one embodiment of the disclosed subject matter in detail, it is to be understood that the disclosed subject matter is not limited in its application to the details of construction and the arrangement of the components set forth in the following description or illustrated in the drawings. The disclosed subject matter is capable of other embodiments or of being practiced or carried out in various ways. Also, it is to be understood that the phraseology and terminology employed herein is for the purpose of description and should not be regarded as limiting. The drawings are generally not to scale. For clarity, non-essential elements were omitted from some of the drawings.

The disclosed subject matter provides a protective hood for a bed that comprises:

a constant hood structure having an opening, wherein the hood structure is configured to accommodate a portion of the bed that partially protrudes through the opening;

a closing board outwardly connected to the hood structure and positioned opposite the opening;

a movable portion sleeved juxtaposed to the constant structure, wherein the movable portion is configured to move relative to the constant structure so as to elongate the constant structure from a first position in which the movable portion is fully adjacent to the constant structure and a second position in which the movable portion is extended outwardly beyond the opening so as to cling to the closing board and form a protected and secure inner space.

The secure inner space is dedicated for an individual that needs to rest.

Optionally, the closing board can be attached to the end of the bed that is beyond the opening of the hood structure.

Optionally, the movable portion can be inwardly to the constant hood structure or outwardly to it. In any case, it is intended to elongate the hood structure.

Figure 2:
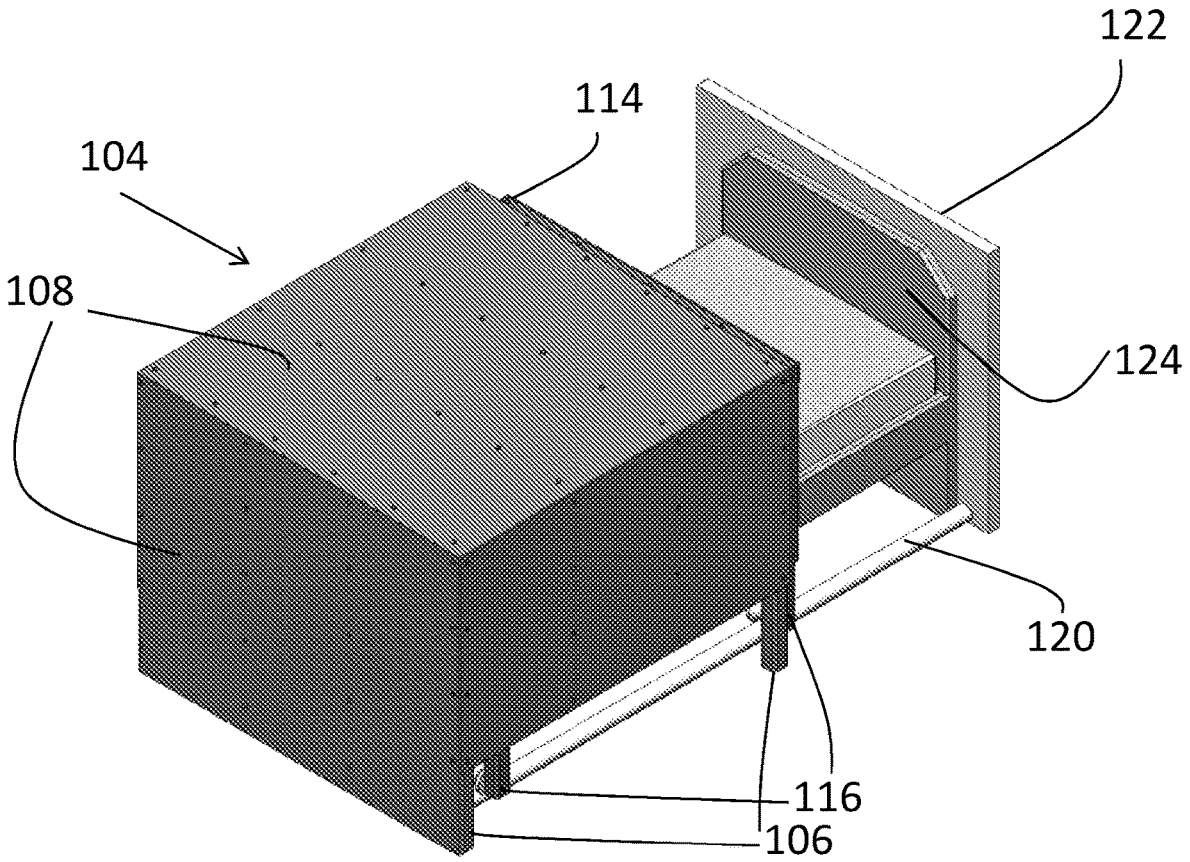
FIG. 2 illustrates the ballistic hood as shown in FIG. 1, in an open state from another direction.

Referring now to FIGS. 1 and 2 illustrating a ballistic hood, in accordance with some exemplary embodiments of the disclosed subject matter, viewed from two different directions. The ballistic bed hood 100 is configured to protect a user that is lying on a bed 102. The bed 102 can be a regular bed or a dedicated for the system bed that is connected to the hood or not. It is possible that the bed and the hood will have a reversible connection that can be open when desired, for example, when the bed or the hood should be replaced or moved, and can be closed when the system is in regular use.

It should be mentioned that along this disclosure, the use of the word bed is defined as any support for use by an individual or more than one individual and can be any sized bed, an armchair, a sofa or a combination thereof.

The ballistic hood 100 comprises of two parts—a constant portion 104 that comprises four sides—an upper side, two opposite sides, and an enclosure so that together, they form an open box. The constant portion 104 is provided with legs 106 configured to hold the structure on the ground. The legs can be provided with length adjustment elements in order to keep the hood balanced. The lower level of the legs is adjusted to the level of the closing board or legs of the closing board 122 so that the whole structure is stable on the ground.

The sides of constant portion 104 are covered with ballistic protecting boards 108 that can be connected to a framework 110 and/or internal boards 112 by bolts, screws 113, or any connection that is strong enough to withstand blast.

The framework can be provided with additional rails that can receive adjacent ballistic protecting boards that form a multilayer protection to the hood so as to withstand a massive attack. Such multilayered protection is described in PCT/IL2016/050698 that is incorporated herein by reference.

The ballistic protecting boards can be such boards that are known and used in the field of ballistic protection and to be more specific, the ballistic boards can be made of materials selected from hard metals such as steel, fiberglass, or softer materials such as polymers as polyethylene or Kevlar as well as composite materials and combination thereof.

Figure 3:
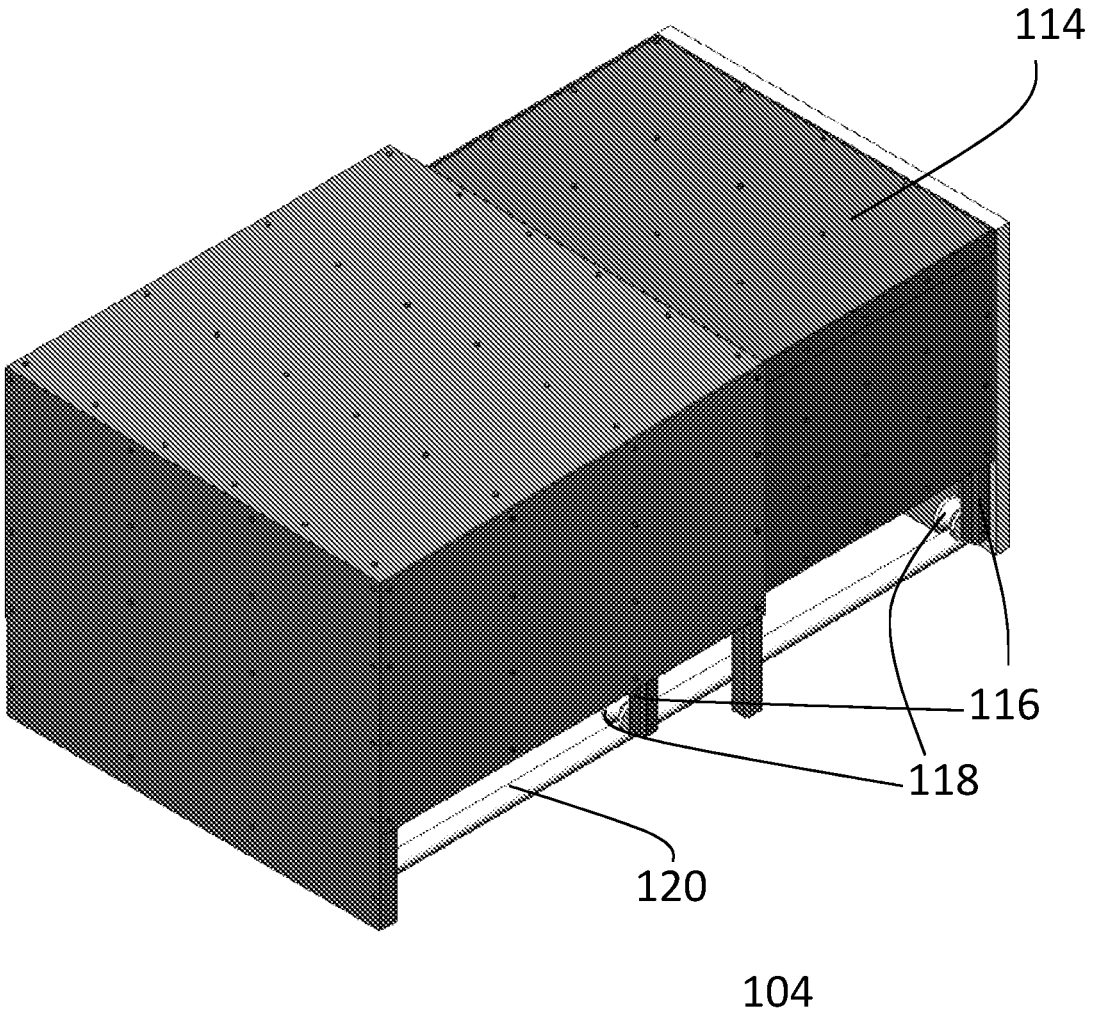
FIG. 3 illustrates the ballistic hood as shown in FIG. 1, in a close state.
Figure 4:
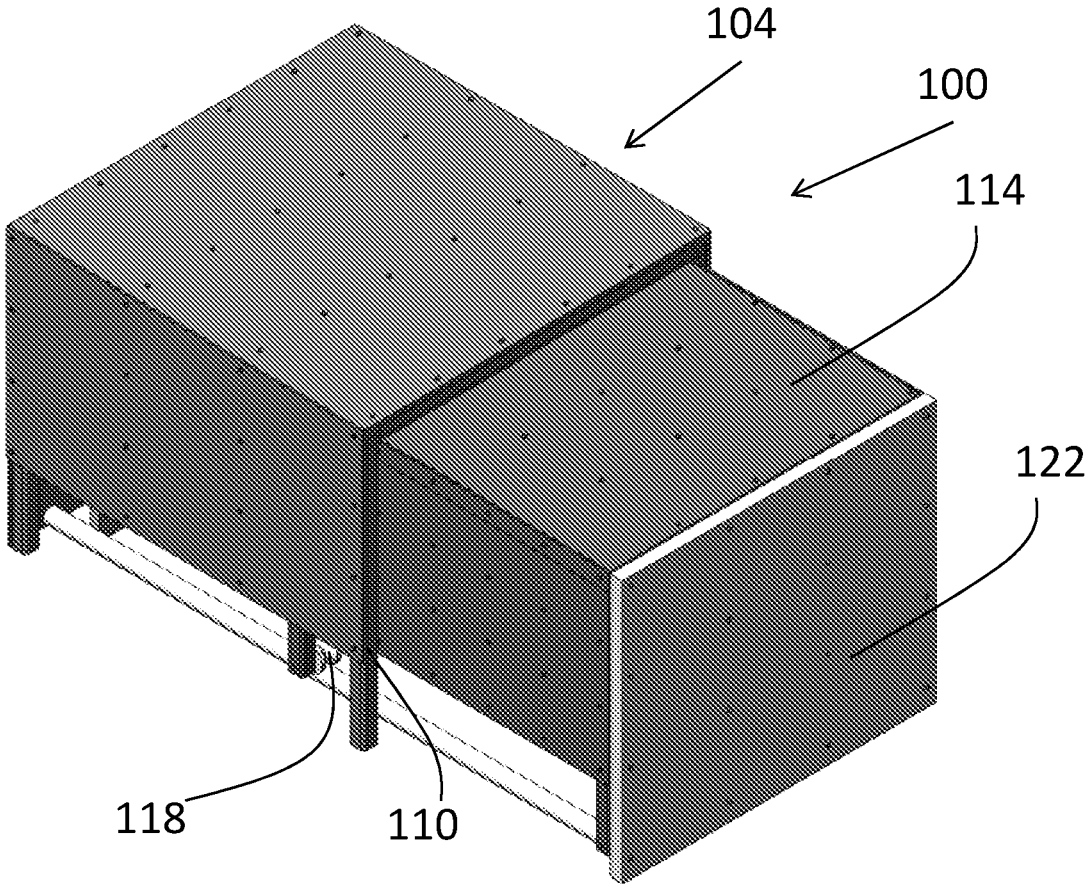
FIG. 4 illustrates the ballistic hood as shown in FIG. 1, in a close state from another direction.

The other part of the ballistic hood 100 is a slidable portion 114 or a movable portion that moves relative to the constant portion. The slidable portion is better seen in FIGS. 3 and 4 illustrating the ballistic hood as shown in FIG. 1, in a close state, views from two different directions. The slidable portion 114 comprises three sided protective boards that correspond to be accommodated within constant portion 104 while the three sides are configure to be juxtaposed to the upper and the two opposite sides (such as an open tube) of the open box that is formed by the constant portion 104.

Slidable portion 114 is provided with legs 116 having wheels 118 that are configured to slide upon a rail 120, from its open state in which almost all the slidable portion is accommodated within the constant portion and the close state in which the slidable portion is withdrawn from within the constant portion to extend so as to cover the entire bed 102. It should be noted that the sides of the slidable portion 114 is also protected using ballistic boards that are covering an internal framework and boards (cannot be seen in the figures).

Rail 120 is preferably positioned in the lower part of the ballistic bed hood connected from one side to the enclosure of the constant portion 104 and from the other side, to a closing board 122. Closing board 122 is provided and connected to the side of the bed 124 (seen in FIG. 2) that is not accommodated within the constant portion 104, but to the bed's opposite end. It should be noticed that in some embodiments, it is possible that the inside portion of the bed will be connected to the hood, however, it is possible that there is no firm connection between the bed and the constant portion as mentioned herein before. When the hood is closed, as seen in FIGS. 3 and 4, the whole bed is covered with ballistic boards that ensure a person within the hood to be protected from hazards.

In the embodiment shown herein, the sliding portion is positioned within the constant portion. It should be mentioned that the slidable portion of the ballistic bed hood can be made in such a way that it will be positioned outer to the constant portion and will slide on top of it.

In accordance with another preferred embodiment, the ballistic bed hood is provided with isolating materials that can be equipped between the two portions, the constant and the sliding portions, as well as a layer of the portion walls themselves. Softening or isolating (thermally or noise) materials can be employed such as sponges or foamed polymers made of material selected from a group such as polystyrene or polyurethane.

The usage of the ballistic bed hood is straight forward: when the user wants to get into bed or out of the bed, he or she slides the slidable portion to within the constant portion. When the user is going to sleep, he or she may slide the slidable portion so as to cover the entire bed and be protected while sleeping.

In accordance with another preferred embodiment, the slidable portion is provided with wheels that are rolling on the floor rather than on a dedicated rail. This is preferable in cases the floor in the area is straight without or with minimum dirt on it that may harm the wheels or any other mechanism that can be used in order to move the slidable portion. In cases the hood is to be used outdoors, as an example, the sliding system with the rail is more appropriate for use.

In accordance with another preferred embodiment, the sliding mechanism is placed between the juxtaposed upper sides of the slidable portion and the constant portion. Other placements of the sliding mechanism can be employed without limiting the scope of the subject matter.

Figure 5:
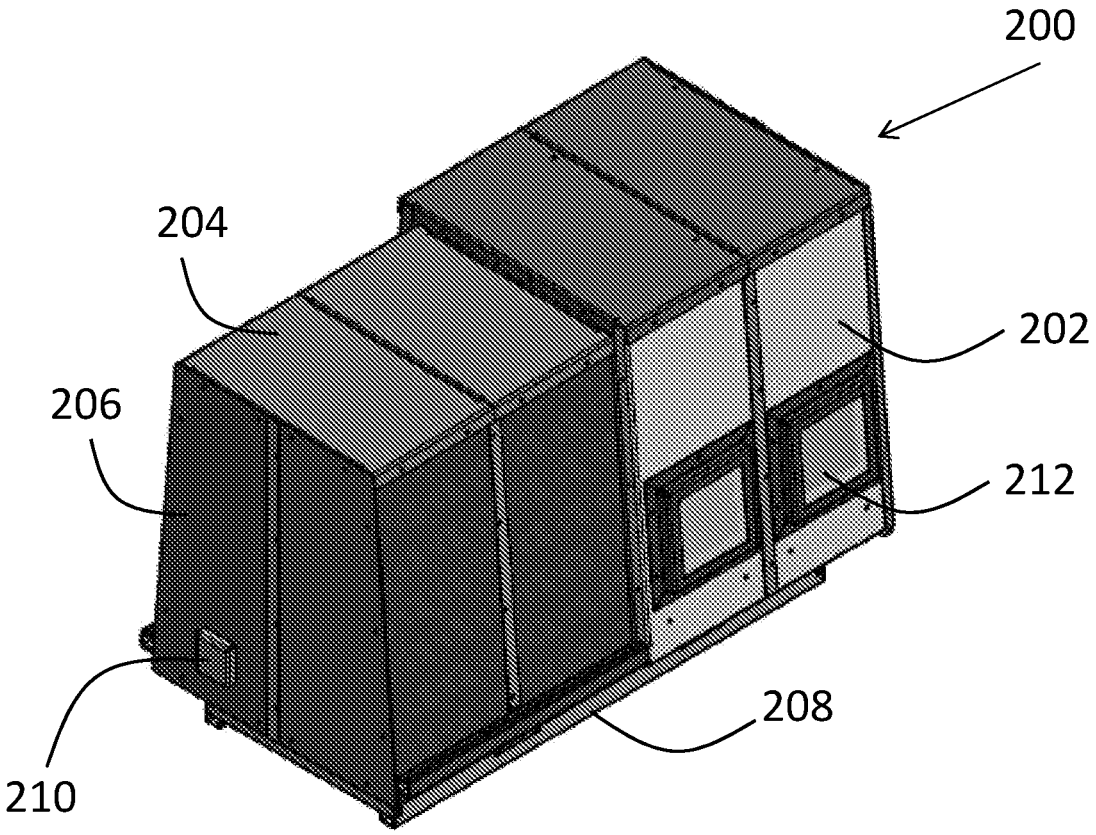
FIG. 5 illustrates a ballistic hood in accordance with another exemplary embodiment of the disclosed subject matter in closed state.

Reference is now made to FIG. 5 illustrating a ballistic hood in accordance with another exemplary embodiment of the disclosed subject matter in closed state. The ballistic hood 200 is provided with the constant hood structure 202, a complementary movable portion 204, and a closing board 206. Support of the bed 208 can be seen from below the structure. Ballistic boards are covering the whole ballistic hood, from all sides that may be exposed to such harm.

The ballistic bed hood 200 is provided with at least one ventilation hole 210. Since the hood is enclosing a relatively small volume and can be closed for several hours, it can be unpleasant to the user to breath within the hood especially in hot geographic areas or cold and therefore, protected venting holes can be provided in the sides of the hood so as to allow air to flow in and out the hood. It is also possible to provide a system that can condition the air within the ballistic bed hood through the venting holes, such as portable air conditioner. The air conditioning can be provided with filters of air such as dust or toxin filters (filters are not shown in the figures).

For safety reasons, the venting holes or part of them can be provided with blast valves. Air enters the protected space inside the closed ballistic bed hood through the blast valves to protect from blast waves and their adverse effects.

In accordance with yet another preferred embodiment, the ballistic bed hood is provided with at least one side window 212 made of a resistant and transparent material such as polycarbonate so that the user can communicate with the people around him and see the outside of the hood. The strength of the transparent resistant material can be adjusted to the specific level of hazard in the geographical placement of the hoods.

In accordance with another preferred embodiment, the closing board is attached to the sliding portion and not to the bed. This is preferable in cases in which there is no desire to form any connection between the bed and the ballistic bed hood. The connection of the closing board to the slidable portion can be employed in several ways. One of which is in a hinged connection wherein the closing board is connected at one end to the end of the upper side of the sliding portion. When the closing board is not enclosing the hood, it can be placed on top of the upper side of the sliding portion. In accordance with yet another preferred embodiment, the sides of the slidable portion distally from the constant portion is provided with rails to which the closing board cab slide in and out. When not in the rails enclosing the opening, it can be placed also on top of the upper portion of the slidable portion or otherwise.

In accordance with another preferred embodiment, the hood can be made of different sizes so as to enclose more than one or two beds positioned side by side or in bunk bed. In the case of multiple beds, there is a possibility to provide several sliding portions so as to allow people to get into the protected hood into the area of their own bed for privacy reasons, especially.

It should also be mentioned that the bed hood can be made of non-ballistic materials and the hood provided for privacy reasons, as an example with a dedicated air-conditioning system to provide a safe and private environment.

In accordance with another preferred embodiment, the inside of the ballistic bed hood is equipped with electricity lines so that light can be used inside the hood as well as radio, computer, TV set etc. communication lines can also be added to the hood.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The invention claimed is:

1. A protective hood for a bed comprising:

a stationary hood structure having an opening, wherein the stationary hood structure is configured to accommodate a portion of the bed that partially protrudes through the opening;

a closing board outwardly connected to the stationary hood structure and positioned opposite the opening;

a movable portion sleeved juxtaposed to the stationary hood structure, wherein the movable portion is configured to move relative to the stationary hood structure so as to elongate the stationary hood structure from a first position in which the movable portion is fully adjacent to the stationary hood structure and a second position in which the movable portion is extended outwardly beyond the opening so as to cling to the closing board and form a protected and secure inner space; and a sliding mechanism configured to allow the movable portion to slide between the first position and the second position, wherein the sliding mechanism is connected between the stationary hood structure and the moving portion and wherein the sliding mechanism comprises a rail and corresponding wheels that slide along each other.

2. The protective hood as claimed in claim 1, wherein the closing board is connected to an end of the bed that protrudes the opening.

3. The protective hood as claimed in claim 1, wherein the stationary hood structure is an open box.

4. The protective hood as claimed in claim 1, wherein isolating material is provided between the stationary hood structure and the movable portion.

5. The protective hood as claimed in claim 4, wherein the isolating material can be sponge or foamed polymers made of material selected from the group consisting of polystyrene, polyurethane, and a combination thereof.

6. The protective hood as claimed in claim 1, wherein the stationary hood structure, the movable portion, and the closing board are covered with ballistic protecting boards connected to a corresponding framework.

7. The protective hood as claimed in claim 6, wherein the framework is configured to receive a plurality of adjacent ballistic protecting boards that form a multilayer protection.

8. The protective hood as claimed in claim 6, wherein the ballistic protecting boards are made of materials selected from the group consisting of hard metals, fiberglass, polymers, composite materials, and a combination thereof.

9. The protection hood as claimed in claim 1, further provided with ventilation holes.

10. The protection hood as claimed in claim 9, wherein the ventilation holes enables air conditioning.

11. The protection hood as claimed in claim 9, wherein the ventilation holes further provided with blast valves.

12. The protection hood as claimed in claim 1, further provided with at least one side window made of a resistant and transparent material.

13. The protection hood as claimed in claim 1, further provided with multimedia system.

14. The protection hood as claimed in claim 1, wherein said constant hood structure is provided with legs to support the protective hood.

15. The protection hood as claimed in claim 14, wherein a lower part of the closing board is at a same lower level as the legs or provided with additional legs that are at a same lower level as the legs.

16. The protective hood as claimed in claim 7, wherein the ballistic protecting boards are made of materials selected from the group of materials consisting of hard metals, fiberglass, polymers, composite materials, and a combination thereof.

* * * * *